US010352579B2

(12) United States Patent
Guo et al.

(10) Patent No.: US 10,352,579 B2
(45) Date of Patent: Jul. 16, 2019

(54) METHOD OF AND SYSTEM FOR DETECTING LOSS OF REFRIGERANT CHARGE

(71) Applicant: Lennox Industries Inc., Richardson, TX (US)

(72) Inventors: LiYing Guo, Addison, TX (US); David Omlor, Flower Mound, TX (US)

(73) Assignee: Lennox Industries Inc., Richardson, TX (US)

( * ) Notice: Subject to any disclaimer, the term of this patent is extended or adjusted under 35 U.S.C. 154(b) by 517 days.

(21) Appl. No.: 15/014,286

(22) Filed: Feb. 3, 2016

(65) Prior Publication Data

US 2017/0219262 A1 Aug. 3, 2017

(51) Int. Cl.

| | |
|---|---|
| ***F25B 45/00*** | (2006.01) |
| ***F24F 11/00*** | (2018.01) |
| ***F24F 11/30*** | (2018.01) |
| ***F24F 11/62*** | (2018.01) |
| ***F25B 49/00*** | (2006.01) |
| *F25B 13/00* | (2006.01) |
| *F24F 140/20* | (2018.01) |
| *F24F 11/36* | (2018.01) |

(52) U.S. Cl.

CPC ..... *F24F 11/30* (2018.01); *F24F 11/62* (2018.01); *F25B 49/005* (2013.01); *F24F 11/36* (2018.01); *F24F 2140/20* (2018.01); *F25B 13/00* (2013.01); *F25B 2313/0314* (2013.01); *F25B 2313/0315* (2013.01); *F25B 2500/222* (2013.01); *F25B 2700/2106* (2013.01); *F25B 2700/21152* (2013.01)

(58) Field of Classification Search

CPC ..... F25B 45/00; F25B 2345/003; F25B 2500/222; F25B 2313/0314; F25B 2700/21152; F25B 2700/2106; F25B 2313/0315

See application file for complete search history.

(56) References Cited

U.S. PATENT DOCUMENTS 4,395,886 A * 8/1983 Mayer ..... F25B 13/00 62/160

7,188,482 B2 * 3/2007 Sadegh ..... F24F 11/0086 165/11.1

(Continued)

*Primary Examiner* — Frantz F Jules
*Assistant Examiner* — Martha Tadesse
(74) *Attorney, Agent, or Firm* — Winstead PC

(57) ABSTRACT

A method of determining loss of refrigerant charge in a heating, ventilation, and air conditioning (HVAC) system. The method includes receiving, using a controller, a plurality of temperature values from a plurality of temperature sensors placed at multiple locations within the HVAC system and calculating, using the controller using the plurality of temperature values, a plurality of temperature-dependent values. The method further includes determining, using the controller, whether a first temperature-dependent value of the plurality of temperature-dependent values is above a first predetermined temperature value and responsive to a determination that the first temperature-dependent value is above the first predetermined temperature value, transmitting, using the controller to a user interface, a notification indicating that the HVAC system is operating with low refrigerant charge.

14 Claims, 3 Drawing Sheets

(56) References Cited

U.S. PATENT DOCUMENTS

| | | | | |
|---|---|---|---|---|
| 7,866,172 | B2 * | 1/2011 | Douglas | F25B 41/003 62/127 |
| 8,655,491 | B2 * | 2/2014 | Hadzidedic | F24F 11/77 700/276 |
| 2003/0089119 | A1 * | 5/2003 | Pham | A47F 3/04 62/131 |
| 2006/0042276 | A1 * | 3/2006 | Doll, Jr. | F25B 49/005 62/129 |
| 2006/0137366 | A1 * | 6/2006 | Kang | F25B 45/00 62/149 |
| 2006/0185373 | A1 * | 8/2006 | Butler | F25B 49/02 62/181 |

* cited by examiner

METHOD OF AND SYSTEM FOR DETECTING LOSS OF REFRIGERANT CHARGE

TECHNICAL FIELD

The present invention relates generally to heating, ventilation, and air conditioning (HVAC) systems and, more particularly, but not by way of limitation, to detecting loss of refrigerant charge in the HVAC system.

BACKGROUND

HVAC systems are used to regulate environmental conditions within an enclosed space. Typically, HVAC systems have a circulation fan that pulls air from the enclosed space through ducts and pushes the air back into the enclosed space through additional ducts after conditioning the air (e.g., heating, cooling, humidifying, or dehumidifying the air). To direct operation of the circulation fan and other components, HVAC systems include a controller. In addition to directing operation of the HVAC system, the controller may be used to monitor various components (i.e., equipment) of the HVAC system to determine if the components are functioning properly.

SUMMARY

A method of determining loss of refrigerant charge in a heating, ventilation, and air conditioning (HVAC) system. The method includes receiving, using a controller, a plurality of temperature values from a plurality of temperature sensors placed at multiple locations within the HVAC system and calculating, using the controller using the plurality of temperature values, a plurality of temperature-dependent values. The method further includes determining, using the controller, whether a first temperature-dependent value of the plurality of temperature-dependent values is above a first predetermined temperature value and responsive to a determination that the first temperature-dependent value is above the first predetermined temperature value, transmitting, using the controller to a user interface, a notification indicating that the HVAC system is operating with low refrigerant charge.

A heating, ventilation, and air conditioning (HVAC) system for determining loss of refrigerant charge, the system comprises a plurality of temperature sensors placed at multiple locations within the HVAC system and a controller operatively coupled to the plurality of temperature sensors. The controller is configured to receive a plurality of temperature values from a plurality of temperature sensors placed at multiple locations within the HVAC system, calculate using the plurality of temperature values, a plurality of temperature-dependent values, determine whether a first temperature-dependent value of the plurality of temperature-dependent values is above a first predetermined temperature value, and responsive to a determination that the first temperature-dependent value is above the first predetermined temperature value, transmit a notification indicating that the HVAC system is operating with low refrigerant charge.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Various embodiments of the present invention will now be described more fully with reference to the accompanying drawings. The invention may, however, be embodied in many different forms and should not be construed as limited to the embodiments set forth herein.

HVAC systems are designed to operate appropriately with a predetermined refrigerant charge. Ideally, HVAC systems would never require refrigerant recharge; however, leaks do develop over time depleting the refrigerant charge. Several factors indicate a depleted level of refrigerant charge. The factors may be, for example, low HVAC system efficiency, lower temperatures from condenser, and the like. If a depleted level of refrigerant charge is suspected, the condition must be verified. Normally, this is done by a service technician performing tests using a set of tools including expensive pressure gauges and intrusive pressure taps. Such procedures to determine depleted level of refrigerant charge are expensive and time consuming. Systems and method are needed to automatically detect loss of refrigerant charge, as early as the HVAC system losing 7-10% of the designated capacity, without a need for the service technician or expensive equipment.

Figure 1:
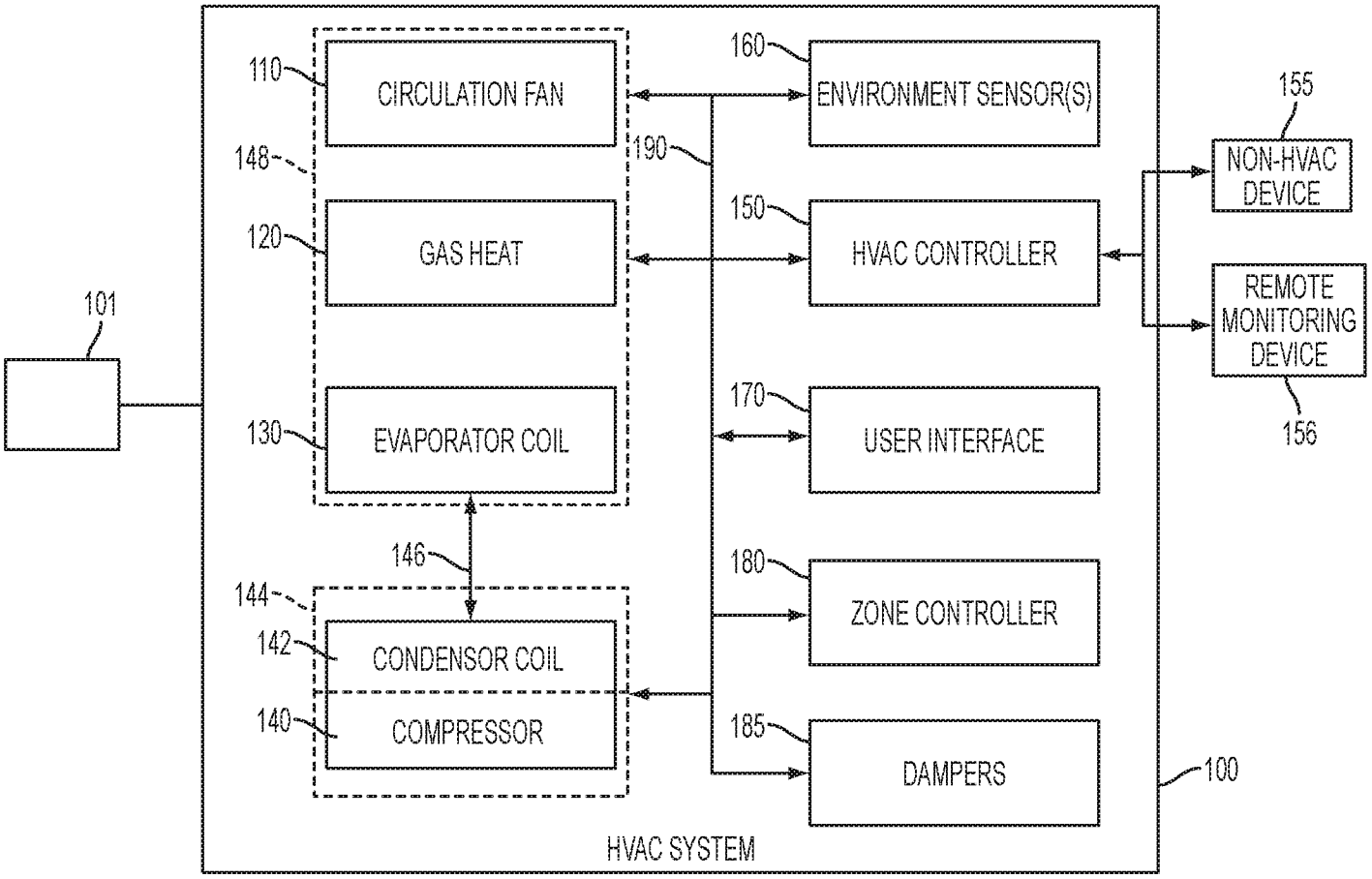
FIG. 1 is a block diagram of an exemplary HVAC system.

FIG. 1 illustrates an HVAC system 100. In a typical embodiment, the HVAC system 100 is a networked HVAC system that is configured to condition air via, for example, heating, cooling, humidifying, or dehumidifying air within an enclosed space 101. In a typical embodiment, the enclosed space 101 is, for example, a house, an office building, a warehouse, and the like. Thus, the HVAC system 100 can be a residential system or a commercial system such as, for example, a roof top system. For exemplary illustration, the HVAC system 100 as illustrated in FIG. 1 includes various components; however, in other embodiments, the HVAC system 100 may include additional components that are not illustrated but typically included within HVAC systems.

The HVAC system 100 includes a circulation fan 110, a gas heat 120 typically associated with the circulation fan 110, and a refrigerant evaporator coil 130, also typically associated with the circulation fan 110. The circulation fan 110, the gas heat 120, and the refrigerant evaporator coil 130 are collectively referred to as an "indoor unit" 148. In a typical embodiment, the indoor unit 148 is located within, or in close proximity to, the enclosed space 101. The HVAC system 100 also includes a compressor 140 and an associated condenser coil 142, which are typically referred to as an "outdoor unit" 144. In various embodiments, the outdoor unit 144 is, for example, a rooftop unit or a ground-level unit. The compressor 140 and the associated condenser coil 142 are connected to the refrigerant evaporator coil 130 by a refrigerant line 146. In a typical embodiment, the refrigerant line 146 comprises a plurality of copper pipes that connect the associated condenser coil 142 to the refrigerant evaporator coil 130. In a typical embodiment, the compressor 140 is, for example, a single-stage compressor, a multi-stage compressor, a single-speed compressor, or a variable-speed compressor. The circulation fan 110, sometimes referred to as a blower, is configured to operate at different capacities (i.e., variable motor speeds) to circulate air through the HVAC system 100, whereby the circulated air is conditioned and supplied to the enclosed space 101.

Still referring to FIG. 1, the HVAC system 100 includes an HVAC controller 150 that is configured to control operation of the various components of the HVAC system 100 such as, for example, the circulation fan 110, the gas heat 120, and the compressor 140 to regulate the environment of the enclosed space 101. In some embodiments, the HVAC system 100 can be a zoned system. In such embodiments, the HVAC system 100 includes a zone controller 180, dampers 185, and a plurality of environment sensors 160. In a typical embodiment, the HVAC controller 150 cooperates with the zone controller 180 and the dampers 185 to regulate the environment of the enclosed space 101.

The HVAC controller 150 may be an integrated controller or a distributed controller that directs operation of the HVAC system 100. In a typical embodiment, the HVAC controller 150 includes an interface to receive, for example, thermostat calls, temperature setpoints, blower control signals, environmental conditions, and operating mode status for various zones of the HVAC system 100. For example, in a typical embodiment, the environmental conditions may include indoor temperature and relative humidity of the enclosed space 101. In a typical embodiment, the HVAC controller 150 also includes a processor and a memory to direct operation of the HVAC system 100 including, for example, a speed of the circulation fan 110.

Still referring to FIG. 1, in some embodiments, the plurality of environment sensors 160 are associated with the HVAC controller 150 and also optionally associated with a user interface 170. The plurality of environment sensors 160 provide environmental information within a zone or zones of the enclosed space 101 such as, for example, temperature and humidity of the enclosed space 101 to the HVAC controller 150. The plurality of environment sensors 160 may also send the environmental information to a display of the user interface 170. In some embodiments, the user interface 170 provides additional functions such as, for example, operational, diagnostic, status message display, and a visual interface that allows at least one of an installer, a user, a support entity, and a service provider to perform actions with respect to the HVAC system 100. In some embodiments, the user interface 170 is, for example, a thermostat of the HVAC system 100. In other embodiments, the user interface 170 is associated with at least one sensor of the plurality of environment sensors 160 to determine the environmental condition information and communicate that information to the user. The user interface 170 may also include a display, buttons, a microphone, a speaker, or other components to communicate with the user. Additionally, the user interface 170 may include a processor and memory that is configured to receive user-determined parameters such as, for example, a relative humidity of the enclosed space 101, and calculate operational parameters of the HVAC system 100 as disclosed herein.

In a typical embodiment, the HVAC system 100 is configured to communicate with a plurality of devices such as, for example, a monitoring device 156, a communication device 155, and the like. In a typical embodiment, the monitoring device 156 is not part of the HVAC system. For example, the monitoring device 156 is a server or computer of a third party such as, for example, a manufacturer, a support entity, a service provider, and the like. In other embodiments, the monitoring device 156 is located at an office of, for example, the manufacturer, the support entity, the service provider, and the like.

In a typical embodiment, the communication device 155 is a non-HVAC device having a primary function that is not associated with HVAC systems. For example, non-HVAC devices include mobile-computing devices that are configured to interact with the HVAC system 100 to monitor and modify at least some of the operating parameters of the HVAC system 100. Mobile computing devices may be, for example, a personal computer (e.g., desktop or laptop), a tablet computer, a mobile device (e.g., smart phone), and the like. In a typical embodiment, the communication device 155 includes at least one processor, memory and a user interface, such as a display. One skilled in the art will also understand that the communication device 155 disclosed herein includes other components that are typically included in such devices including, for example, a power supply, a communications interface, and the like.

The zone controller 180 is configured to manage movement of conditioned air to designated zones of the enclosed space 101. Each of the designated zones include at least one conditioning or demand unit such as, for example, the gas heat 120 and the user interface 170 such as, for example, the thermostat. The HVAC system 100 allows the user to independently control the temperature in the designated zones. In a typical embodiment, the zone controller 180 operates dampers 185 to control air flow to the zones of the enclosed space 101.

In some embodiments, a data bus 190, which in the illustrated embodiment is a serial bus, couples various components of the HVAC system 100 together such that data is communicated therebetween. In a typical embodiment, the data bus 190 may include, for example, any combination of hardware, software embedded in a computer readable medium, or encoded logic incorporated in hardware or otherwise stored (e.g., firmware) to couple components of the HVAC system 100 to each other. As an example and not by way of limitation, the data bus 190 may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus 190 may include any number, type, or configuration of data buses 190, where appropriate. In particular embodiments, one or more data buses 190 (which may each include an address bus and a data bus) may couple the HVAC controller 150 to other components of the HVAC system 100. In other embodiments, connections between various components of the HVAC system 100 are wired. For example, conventional cable and contacts may be used to couple the HVAC controller 150 to the various components. In some embodiments, a wireless connection is employed to provide at least some of the connections between components of the HVAC system such as, for example, a connection between the HVAC controller 150 and the circulation fan 110 or the plurality of environment sensors 160.

Figure 2:
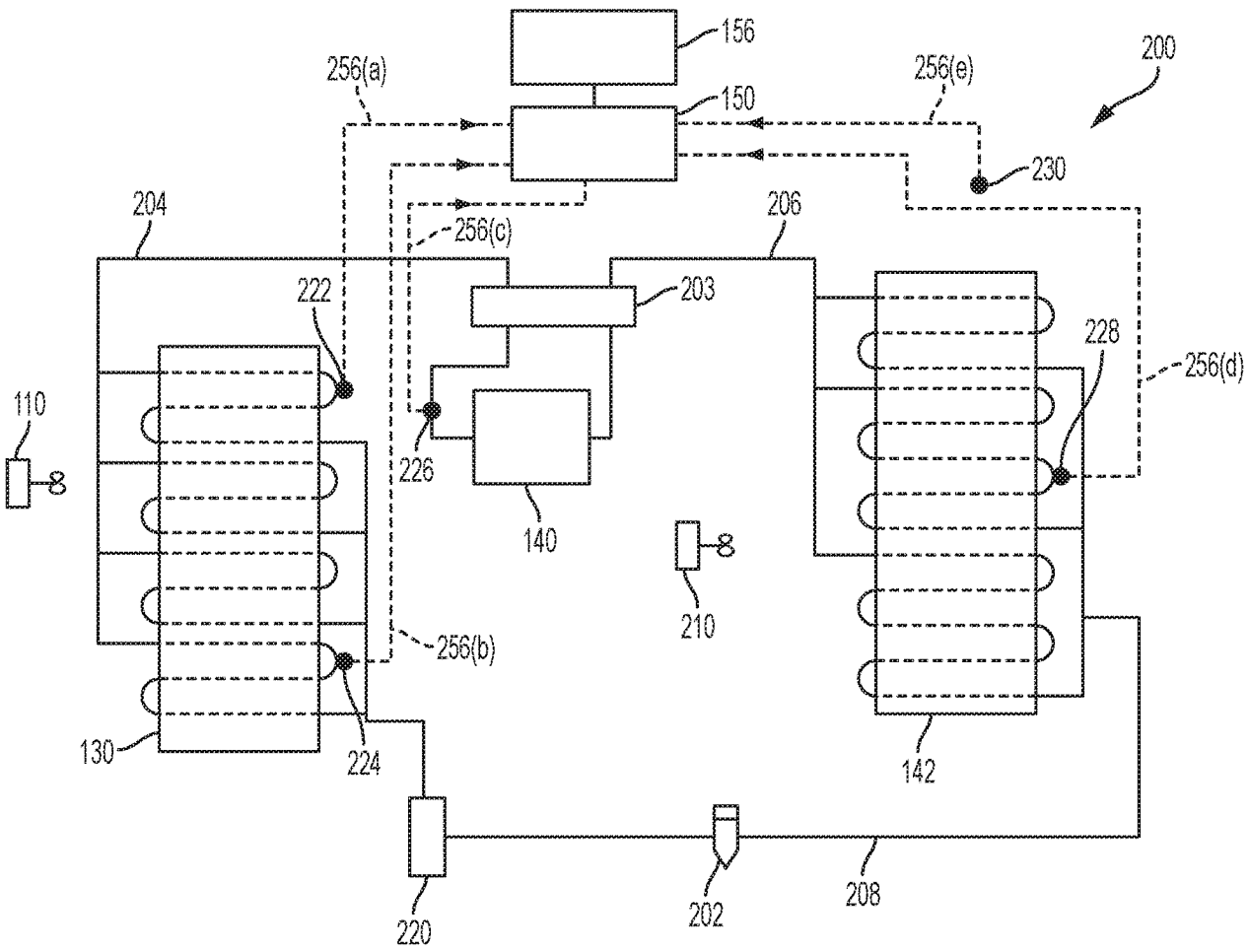
FIG. 2 is a schematic diagram of an exemplary HVAC system.

FIG. 2 is a schematic diagram of an exemplary HVAC system 200. For illustrative purposes, FIG. 2 will be described herein relative to FIG. 1. The HVAC system 200 includes the refrigerant evaporator coil 130, the condenser coil 142, the compressor 140, a metering device 202, and a reversing valve 203. In a typical embodiment, the metering device 202 is, for example, a thermostatic expansion valve or a throttling valve. The refrigerant evaporator coil 130 is fluidly coupled to the compressor 140 via a suction line 204. The compressor 140 is fluidly coupled to the condenser coil 142 via a discharge line 206. In a typical embodiment, the compressor 140 may be, for example, a variable-speed compressor or a non-variable speed compressor. The condenser coil 142 is fluidly coupled to the metering device 202 via a liquid line 208. The metering device 202 is fluidly coupled to a distributor 220. The distributor 220 distributes flow of the refrigerant emerging from the metering device 202 into a plurality of distributor lines.

Still referring to FIG. 2, during operation, low-pressure, low-temperature refrigerant is circulated through the refrigerant evaporator coil 130. The refrigerant is initially in a liquid/vapor state. In a typical embodiment, the refrigerant is, for example, R-22, R-134a, R-410A, R-744, or any other suitable type of refrigerant as dictated by design requirements. Air from within the enclosed space 101, which is typically warmer than the refrigerant, is circulated around the refrigerant evaporator coil 130 by the circulation fan 110. In a typical embodiment, the refrigerant begins to boil after absorbing heat from the air and changes state to a low-pressure, low-temperature, super-heated vapor refrigerant. Saturated vapor, saturated liquid, and saturated fluid refer to a thermodynamic state where a liquid and its vapor exist in approximate equilibrium with each other. Super-heated fluid and super-heated vapor refer to a thermodynamic state where a vapor is heated above a saturation temperature of the vapor. Sub-cooled fluid and sub-cooled liquid refers to a thermodynamic state where a liquid is cooled below the saturation temperature of the liquid.

The low-pressure, low-temperature, super-heated vapor refrigerant is introduced into the compressor 140 via the suction line 204. In a typical embodiment, the compressor 140 increases the pressure of the low-pressure, low-temperature, super-heated vapor refrigerant and, also increases the temperature of the low-pressure, low-temperature, super-heated vapor refrigerant to form a high-pressure, high-temperature, superheated vapor refrigerant. In the context of the present application, a temperature difference between a discharge temperature and a saturated discharge temperature along with an adjustment using outdoor ambient temperature ($T_{od}$) is referred to as a discharge-superheat temperature (DSH).

The HVAC system 200 includes a plurality of temperature sensors that are placed at various positions within the HVAC system 100 to measure temperature. For example, the HVAC system 200 includes a first temperature sensor 222, a second temperature sensor 224, a third temperature sensor 226, a fourth temperature sensor 228, and a fifth temperature sensor 230. For exemplary purposes, only five temperature sensors 222, 224, 226, 228, 230 are illustrated; however, in alternate embodiments, any number of temperature sensors can be utilized as dictated by design requirements.

In a typical embodiment, the first temperature sensor 222 is thermally exposed at at least an upper section of the refrigerant evaporator coil 130 and is configured to measure a temperature around the upper section of the refrigerant evaporator coil 130 ($T_{evapH}$). The second temperature sensor 224 is thermally exposed at at least a lower section of the refrigerant evaporator coil 130 and is configured to measure a temperature around the lower section of the refrigerant evaporator coil 130 ($T_{evapL}$). The third temperature sensor 226 is thermally exposed at the suction line 204 before the suction line 206 enters the evaporator coil 142. The third temperature sensor 226 is configured to measure compressor-discharge temperature ($T_{disc}$). The fourth temperature sensor 228 is thermally exposed at at least a central section of the condenser coil 142. The fourth temperature sensor 228 is configured to measure outdoor mid-circuit-condenser temperature ($T_{mod}$). The fifth temperature sensor 230 is configured to measure the outdoor ambient temperature ($T_{od}$).

In various embodiments, the temperature values received by the HVAC controller 150 from the plurality of temperature sensors 222, 224, 226, 228, 230 are utilized to calculate temperature-dependent values. The temperature-dependent values are typically used to evaluate the HVAC system performance. In some embodiments, the temperature-dependent values are utilized to detect loss of refrigerant charge in the HVAC system 200.

Some of the temperature-dependent values will now be described in further detail below. In a typical embodiment, a normal temperature difference between the lower section of the refrigerant evaporator coil 130 ($nT_{evapL}$) and the upper section of the refrigerant evaporator coil 130 ($nT_{evapH}$) is referred herein as $NT_{dsgn}$. Typically, the normal temperature difference between $nT_{evapL}$ and $nT_{evapH}$ is between approximately 1° F.-10° F. The normal temperature difference can be calculated using the equation listed below:

$$NT_{dsgn}=|nT_{evapL}-nT_{evapH}| \quad \text{(Equation 1)}$$

In a typical embodiment, a temperature difference between the outdoor mid-circuit-condenser temperature ($T_{mod}$) and the outdoor ambient temperature ($T_{od}$) is referred herein as dTOD. dTOD can be calculated using the equation listed below:

$$dTOD=T_{mod}-T_{od} \quad \text{(Equation 2)}$$

In a typical embodiment, an actual temperature difference between the lower section of the refrigerant evaporator coil 130 ($T_{evapL}$) and the upper section of the refrigerant evaporator coil 130 ($aT_{evapH}$) is referred herein as $d_{evap}$. The actual temperature difference can be calculated using the equation listed below:

$$d_{evap}=|T_{evapL}-T_{evapH}| \quad \text{(Equation 3)}$$

The discharge-superheat temperature (DSH) can be calculated using the equation listed below:

$$DSH=(T_{disc}-T_{mod})*(82/T_{od}) \quad \text{(Equation 4)}$$

As stated above, DSH refers to the discharge-superheat temperature, $T_{disc}$ refers to the compressor-discharge temperature, $T_{mod}$ refers to the outdoor mid-circuit-condenser temperature, and $T_{od}$ refers to outdoor ambient temperature.

Table 1 below illustrates symbols and abbreviations used to perform temperature calculations described above.

TABLE 1

| Symbols | Abbreviations |
|---|---|
| $T_{mod}$ | Outdoor mid-circuit-Condenser Temperature |
| $T_{disc}$ | Compressor-Discharge Temperature |
| $T_{od}$ | Outdoor Ambient Temperature |
| $T_{evapH}$ | Temperature of upper Section of Refrigerant Evaporator Coil |
| $T_{evapL}$ | Temperature of Lower Section of Refrigerant Evaporator Coil |
| $NT_{dsgn}$ | $\lvert nT_{evapL} - nT_{evapH}\rvert$ |
| dTOD | $T_{mod} - T_{od}$ |
| $d_{evap}$ | $\lvert T_{evapL} - T_{evapH}\rvert$ |
| DTD | $2* NT_{dsgn}$ |
| DSH | $(T_{disc} - T_{mod}) * (82/T_{od})$ |

In a typical embodiment, the plurality of temperature sensors 222, 224, 226, 228, 230 are, for example, thermistors; however, in other embodiments, the plurality of temperature sensors 222, 224, 226, 228, 230 may be thermocouples, thermometers, or other appropriate devices as dictated by design requirements. The plurality of temperature sensors 222, 224, 226, 228, 230 communicate with the HVAC controller 150 as illustrated in FIG. 2 by 256 (*a*)-(*e*). In various embodiments, the plurality of temperature sensors 222, 224, 226, 228, 230 communicate with the HVAC controller 150 via, for example, a wired connection or a wireless connection. The HVAC controller 150 is coupled to the monitoring device 156.

Figure 3:
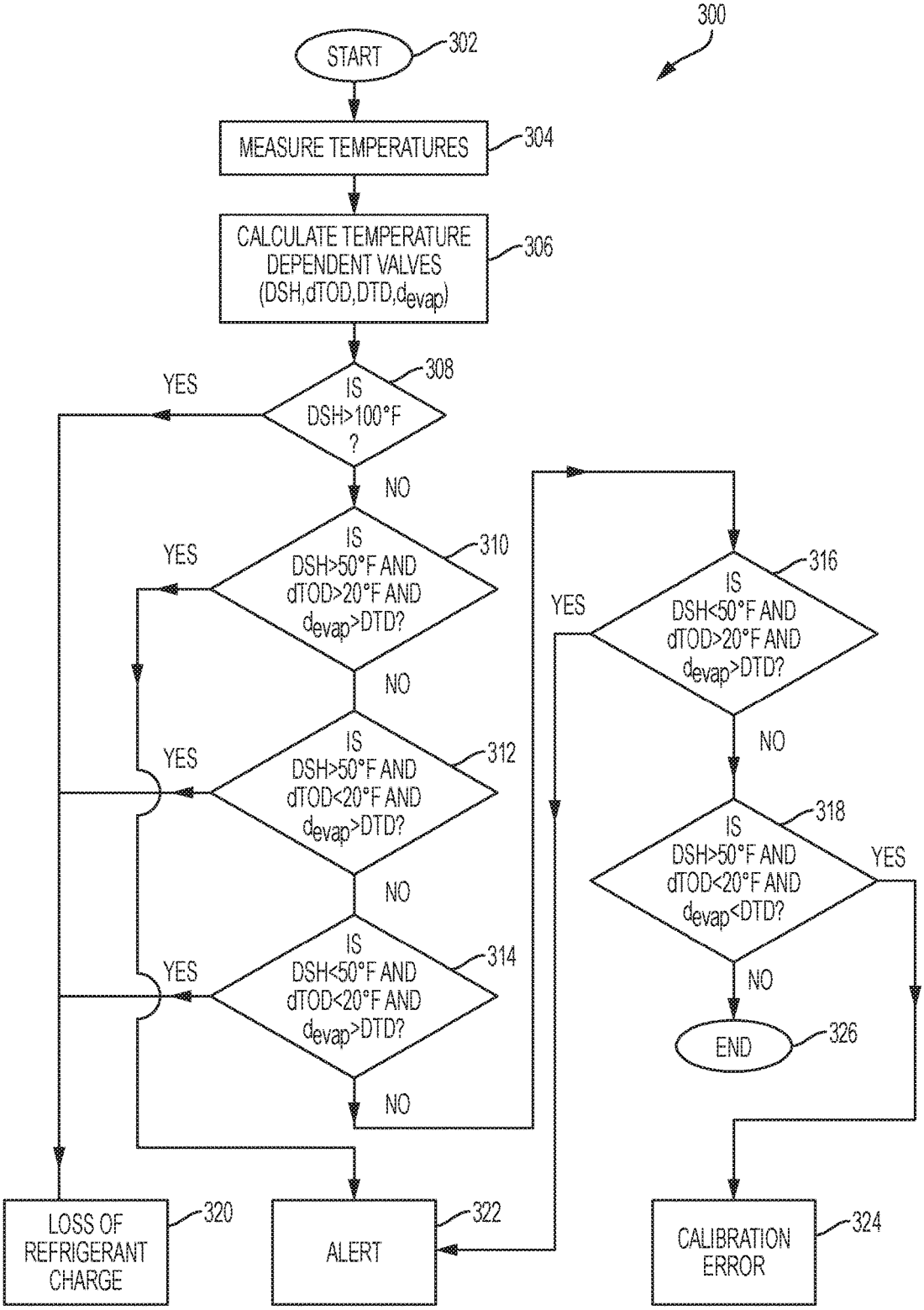
FIG. 3 is a flow diagram illustrating an exemplary process 300 to determine loss of refrigerant charge.

FIG. 3 is a flow diagram illustrating an exemplary process 300 to determine loss of refrigerant charge. For illustrative purposes, the process 300 will be described herein relative to FIGS. 1-2. The process 300 begins at step 302. At step 304, temperature readings at various positions of the HVAC system 200 are collected via the plurality of temperature sensors 222, 224, 226, 228, 230. For example, the first temperature sensor 222 is configured to measure the temperature ($T_{evapH}$) around the upper section of the refrigerant evaporator coil 130. The second temperature sensor 224 is configured to measure a temperature ($T_{evapL}$) around the lower section of the refrigerant evaporator coil 130. The third temperature sensor 226 is configured to measure the compressor-discharge temperature ($T_{disc}$). The fourth temperature sensor 228 is configured to measure the outdoor mid-circuit-condenser temperature ($T_{mod}$). The fifth temperature sensor 230 is configured to measure the outdoor ambient temperature ($T_{od}$).

From step 304, the process 300 proceeds to step 306. At step 306, a plurality of temperature-dependent values described above are calculated by, for example, the HVAC controller 150. In a typical embodiment, the HVAC controller 150 determines, for example, temperature-dependent values dTOD, DSH, $d_{evap}$, DTD and the like. The temperature-dependent values are typically used to evaluate the HVAC system performance. According to various embodiments, the temperature-dependent values are utilized to detect, for example, loss of refrigerant charge in the HVAC system 200. From step 306, the process 300 proceeds to step 308.

At step 308, it is determined if the calculated temperature-dependent value DSH is greater than a first predetermined temperature value. In a typical embodiment, the first predetermined temperature value is, for example, 100° F. If it is determined at step 308 that the calculated temperature-dependent value DSH is not greater than the first predetermined temperature value, the process 300 proceeds to step 310. However, if it is determined at step 308 that the calculated temperature-dependent value DSH is greater than the first predetermined temperature value, the process 300 proceeds to step 320. At step 320, a notification is sent to the display of the user interface 170 indicating that the HVAC system 100 is operating with low refrigerant charge and requires refrigerant recharge.

At step 310, it is determined if the calculated temperature-dependent value DSH is greater than a second predetermined temperature value and the calculated temperature-dependent value dTOD is greater than a third predetermined temperature value and the calculated temperature-dependent value $d_{evap}$ is greater than the calculated temperature-dependent value DTD. If all of the conditions described in step 310 are true, the process 300 proceeds to step 322. In a typical embodiment, the second predetermined temperature value is, for example, 50° F. In a typical embodiment, the third predetermined temperature value is, for example, 20° F. At step 322, a notification is sent to the display of the user interface 170 indicating that the HVAC system 100 is not operating appropriately due to blockage in, for example, the refrigerant evaporator coil 130. However, if it is determined at step 310 that not all of the conditions described in step 310 are true, the process 300 proceeds to step 312.

At step 312, it is determined if the calculated temperature-dependent value DSH is greater than the second predetermined temperature value and the calculated temperature-dependent value dTOD is less than the third predetermined temperature value and the calculated temperature-dependent value $d_{evap}$ is greater than the calculated temperature-dependent value DTD. If all of the conditions described in step 312 are true, the process 300 proceeds to step 320. At step 320, a notification is sent to the display of the user interface 170 indicating that the HVAC system 100 is operating with low refrigerant charge and requires refrigerant recharge. However, if it is determined at step 312 that not all of the conditions described in step 312 true, the process 300 proceeds to step 314.

At step 314, it is determined if the calculated temperature-dependent value DSH is less than the second predetermined temperature value and the calculated temperature-dependent value dTOD is less than the third predetermined temperature value and the calculated temperature-dependent value $d_{evap}$ is greater than the calculated temperature-dependent value DTD. If all of the conditions described in step 314 are true, the process 300 proceeds to step 320. At step 320, a notification is sent to the display of the user interface 170 indicating that the HVAC system 100 is operating with low refrigerant charge and requires refrigerant recharge. However, if it is determined at step 314 that not all of the conditions described in step 314 are true, the process 300 proceeds to step 316.

At step 316, it is determined if the calculated temperature-dependent value DSH is less than the second predetermined temperature value and the calculated temperature-dependent value dTOD is greater than the third predetermined temperature value and the calculated temperature-dependent value $d_{evap}$ is greater than the calculated temperature-dependent value DTD. If all of the conditions described in step 316 are true, the process 300 proceeds to step 322. At step 322, a notification is sent to the display of the user interface 170 indicating that the HVAC system 100 is not operating appropriately due to blockage in, for example, the refrigerant evaporator coil 130. However, if it is determined at step 316 that not all of the conditions described in step 316 are true, the process 300 proceeds to step 318.

At step 318, it is determined if the calculated temperature-dependent value DSH is greater than the second predetermined temperature value and the calculated temperature-dependent value dTOD is less than the third predetermined temperature value and the calculated temperature-dependent value $d_{evap}$ is less than the calculated temperature-dependent value DTD. If all of the conditions described in step 318 are true, the process 300 proceeds to step 324. At step 324, a notification is sent to the display of the user interface 170 indicating a calibration error. However, if it is determined at step 318 that not all of the conditions described in step 318 are true, the process 300 ends at step 326.

For purposes of this patent application, the term computer-readable storage medium encompasses one or more tangible computer-readable storage media possessing structures. As an example and not by way of limitation, a computer-readable storage medium may include a semiconductor-based or other integrated circuit (IC) (such as, for example, a field-programmable gate array (FPGA) or an application-specific IC (ASIC)), a hard disk, an HDD, a hybrid hard drive (HHD), an optical disc, an optical disc drive (ODD), a magneto-optical disc, a magneto-optical drive, a floppy disk, a floppy disk drive (FDD), magnetic tape, a holographic storage medium, a solid-state drive (SSD), a RAM-drive, a SECURE DIGITAL card, a SECURE DIGITAL drive, a flash memory card, a flash memory drive, or any other suitable tangible computer-readable storage medium or a combination of two or more of these, where appropriate.

Particular embodiments may include one or more computer-readable storage media implementing any suitable storage. In particular embodiments, a computer-readable storage medium implements one or more portions of the processor 320, one or more portions of the system memory 330, or a combination of these, where appropriate. In particular embodiments, a computer-readable storage medium implements RAM or ROM. In particular embodiments, a computer-readable storage medium implements volatile or persistent memory. In particular embodiments, one or more computer-readable storage media embody encoded software.

In this patent application, reference to encoded software may encompass one or more applications, bytecode, one or more computer programs, one or more executables, one or more instructions, logic, machine code, one or more scripts, or source code, and vice versa, where appropriate, that have been stored or encoded in a computer-readable storage medium. In particular embodiments, encoded software includes one or more application programming interfaces (APIs) stored or encoded in a computer-readable storage medium. Particular embodiments may use any suitable encoded software written or otherwise expressed in any suitable programming language or combination of programming languages stored or encoded in any suitable type or number of computer-readable storage media. In particular embodiments, encoded software may be expressed as source code or object code. In particular embodiments, encoded software is expressed in a higher-level programming language, such as, for example, C, Python, Java, or a suitable extension thereof. In particular embodiments, encoded software is expressed in a lower-level programming language, such as assembly language (or machine code). In particular embodiments, encoded software is expressed in JAVA. In particular embodiments, encoded software is expressed in Hyper Text Markup Language (HTML), Extensible Markup Language (XML), or other suitable markup language.

Depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. Although certain computer-implemented tasks are described as being performed by a particular entity, other embodiments are possible in which these tasks are performed by a different entity.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. A method of determining loss of refrigerant charge in a heating, ventilation, and air conditioning (HVAC) system, the method comprising:

receiving, by a controller operatively coupled to a plurality of temperature sensors, a plurality of temperature values from the plurality of temperature sensors placed at multiple locations within the HVAC system, wherein the plurality of temperature sensors communicate with the controller via at least one of a wired connection and a wireless connection:

calculating, using the controller using the plurality of temperature values, a plurality of temperature-dependent values;

determining, using the controller, whether a first temperature-dependent value of the plurality of temperature-dependent values is above a first predetermined temperature value, wherein the first temperature-dependent value comprises a discharge-superheat temperature of a refrigerant (DSH), wherein DSH is calculated using the equation listed below:

$$DSH=(T_{disC}-T_{mod})*(82/T_{od});\text{ and}$$

wherein $T_{disC}$ refers to a compressor-discharge temperature, $T_{mod}$ refers to an outdoor mid-circuit-condenser temperature, and $T_{od}$ refers to outdoor ambient temperature; and responsive to a determination that the first temperature-dependent value is above the first predetermined temperature value, transmitting, using the controller to a user interface, a notification indicating that the HVAC system is operating with low refrigerant charge.

2. The method of claim 1 further comprising:

responsive to a determination that the first temperature-dependent value is below the first predetermined temperature value;

determining, using the controller, whether each of the following three primary conditions is true:

the first temperature-dependent is above a second predetermined temperature value;

a second temperature-dependent value of the plurality of temperature-dependent values is above a third predetermined temperature value; and a third temperature-dependent value of the plurality of temperature-dependent values is above a fourth temperature-dependent value of the plurality of temperature-dependent values; and responsive to a determination each of the three primary conditions is true, transmitting, using the controller to the user interface, a notification indicating that the HVAC system is not operating appropriately due to blockage of a component of the HVAC system.

3. The method of claim 2 further comprising:

responsive to a determination that at least one of the three primary conditions is not true, determining, using the controller, whether each of the following three secondary conditions is true:

the first temperature-dependent is above the second predetermined temperature value;

the second temperature-dependent value of the plurality of temperature-dependent values is below the third predetermined temperature value; and the third temperature-dependent value of the plurality of temperature-dependent values is above the fourth temperature-dependent value of the plurality of temperature-dependent values; and responsive to a determination that each of the three secondary conditions is true, transmitting, using the controller to the user interface, the notification indicating that the HVAC system is operating with low refrigerant charge.

4. The method of claim 3 further comprising:

responsive to a determination that at least one of the three secondary conditions is not true, determining, using the controller, whether each of the following three tertiary conditions is true:

the first temperature-dependent is below the second predetermined temperature value;

the second temperature-dependent value of the plurality of temperature-dependent values is below the third predetermined temperature value; and the third temperature-dependent value of the plurality of temperature-dependent values is above the fourth temperature-dependent value of the plurality of temperature-dependent values; and responsive to a determination that each of the three tertiary conditions is true, transmitting, using the controller to the user interface, the notification indicating that the HVAC system is operating with low refrigerant charge.

5. The method of claim 4 further comprising:

responsive to a determination that at least one of the three tertiary conditions is not true, determining, using the controller, whether each of the following three quaternary conditions is true:

the first temperature-dependent is below the second predetermined temperature value;

the second temperature-dependent value of the plurality of temperature-dependent values is above the third predetermined temperature value; and the third temperature-dependent value of the plurality of temperature-dependent values is above the fourth temperature-dependent value of the plurality of temperature-dependent values; and responsive to a determination that each of the three quaternary conditions is true, transmitting, using the controller to the user interface, a notification indicating that the HVAC system is not operating appropriately due to blockage of a component of the HVAC system.

6. The method of claim 5 further comprising:

responsive to a determination that at least one of the three quaternary conditions is not true, determining, using the controller, whether each of the following three quinary conditions is true:

the first temperature-dependent is above the second predetermined temperature value;

the second temperature-dependent value of the plurality of temperature-dependent values is below the third predetermined temperature value; and the third temperature-dependent value of the plurality of temperature-dependent values is below the fourth temperature-dependent value of the plurality of temperature-dependent values; and responsive to a determination that each of the three quinary conditions is true, transmitting, using the controller to the user interface, a notification indicating a calibration error.

7. The method of claim 6, wherein the second temperature-dependent value comprises a temperature difference between an outdoor mid-circuit-condenser temperature ($T_{mod}$) and an outdoor ambient temperature ($T_{od}$).

8. The method of claim 6, wherein the third temperature-dependent value comprises an actual temperature difference between a lower section of a refrigerant evaporator coil ($T_{evapL}$) and an upper section of the refrigerant evaporator coil ($T_{evapH}$).

9. The method of claim 6, wherein the fourth temperature-dependent value comprises two times a normal temperature difference between a lower section of a refrigerant evaporator coil ($nT_{evapL}$) and an upper section of the refrigerant evaporator coil ($nT_{evapH}$).

10. The method of claim 6, wherein the first predetermined temperature value is approximately 100° F.

11. The method of claim 6, wherein the second predetermined temperature value is approximately 50° F.

12. The method of claim 6, wherein the third predetermined temperature value is approximately 20° F.

13. The method of claim 1, wherein:

a first temperature sensor of the plurality of temperature sensors is thermally exposed at at least an upper section of a refrigerant evaporator coil and is configured to measure temperature around the upper section of the refrigerant evaporator coil;

a second temperature sensor of the plurality of temperature sensors is thermally exposed at at least a lower section of the refrigerant evaporator coil and is configured to measure temperature around the lower section of the refrigerant evaporator coil;

a third temperature sensor of the plurality of temperature sensors is thermally exposed at a compressor discharge line and is configured to measure compressor-discharge temperature;

a fourth temperature sensor of the plurality of temperature sensors is thermally exposed at at least a central section of a condenser coil and is configured to measure outdoor mid-circuit-condenser temperature; and a fifth temperature sensor of the plurality of temperature sensors is configured to measure outdoor ambient temperature.

14. The method of claim 1, wherein the plurality of temperature sensors comprise thermistors.

* * * * *